US007284967B2

(12) United States Patent
Hyeon

(10) Patent No.: US 7,284,967 B2
(45) Date of Patent: Oct. 23, 2007

(54) RELIABILITY-IMPROVING STRUCTURE OF RECIPROCATING COMPRESSOR

(75) Inventor: Seong-Yeol Hyeon, Gyungsangnam-Do (KR)

(73) Assignee: LG Electronics, Inc. (KR)

( * ) Notice: Subject to any disclaimer, the term of this patent is extended or adjusted under 35 U.S.C. 154(b) by 569 days.

(21) Appl. No.: 10/467,849

(22) PCT Filed: Dec. 10, 2002

(86) PCT No.: PCT/KR02/02330

§ 371 (c)(1),
(2), (4) Date: Aug. 13, 2003

(87) PCT Pub. No.: WO03/054390

PCT Pub. Date: Jul. 3, 2003

(65) Prior Publication Data

US 2004/0071568 A1 Apr. 15, 2004

(30) Foreign Application Priority Data

Dec. 10, 2001 (KR) ..... 2001-77916
Dec. 12, 2001 (KR) ..... 2001-78600
Dec. 12, 2001 (KR) ..... 2001-78601

(51) Int. Cl.
*F04B 17/00* (2006.01)
*F04B 35/04* (2006.01)

(52) U.S. Cl. ..... 417/417; 417/363

(58) Field of Classification Search ..... 417/417, 417/63, 363; 310/12, 15
See application file for complete search history.

(56) References Cited

U.S. PATENT DOCUMENTS 3,788,778 A * 1/1974 Miller ..... 417/417
3,814,550 A 6/1974 Adams ..... 417/417
4,854,833 A * 8/1989 Kikuchi et al. ..... 417/417
5,222,878 A * 6/1993 Osada et al. ..... 417/417
5,704,771 A 1/1998 Fujisawa ..... 417/417
5,772,410 A * 6/1998 Chang ..... 417/363
5,920,133 A * 7/1999 Penswick et al. ..... 310/17
5,993,178 A 11/1999 Park et al. ..... 417/545
6,054,783 A * 4/2000 Philipp et al. ..... 310/12
6,077,054 A * 6/2000 Lee et al. ..... 417/417

(Continued)

FOREIGN PATENT DOCUMENTS

EP 994253 A2 * 4/2000

(Continued)

OTHER PUBLICATIONS

International Search Report.

*Primary Examiner*—Anthony D. Stashick
*Assistant Examiner*—Jessica L Frantz
(74) *Attorney, Agent, or Firm*—Ostrolenk, Faber, Gerb & Soffen, LLP

(57) ABSTRACT

In a reliability-improving structure of a reciprocating compressor, by minimizing vibration noise occurred in operation, adjusting a quantity of compression gas accurately, measuring an air gap in order to uniform an air gap of a reciprocating motor in an assembly process and firming combination between an inner stator combined with a piston for compressing gas so as to perform a linear reciprocating motor with the piston and a magnet fixedly combined with the inner stator, reliability of a reciprocating compressor can be improved.

8 Claims, 13 Drawing Sheets

U.S. PATENT DOCUMENTS

| | | | | |
|---|---|---|---|---|
| 6,089,836 | A * | 7/2000 | Seo | 417/417 |
| 6,097,125 | A * | 8/2000 | Park et al. | 310/156.45 |
| 6,174,141 | B1 * | 1/2001 | Song et al. | 417/312 |
| 6,220,393 | B1 * | 4/2001 | Oh et al. | 184/6.16 |
| 6,273,688 | B1 * | 8/2001 | Kawahara et al. | 417/417 |
| 6,323,568 | B1 * | 11/2001 | Zabar | 310/12 |
| 6,379,125 | B1 * | 4/2002 | Tojo et al. | 417/417 |
| 6,920,682 | B2 * | 7/2005 | Ku et al. | 29/596 |
| 2001/0002977 | A1 * | 6/2001 | Morita et al. | 417/417 |
| 2002/0119058 | A1 * | 8/2002 | Kim et al. | 417/417 |

FOREIGN PATENT DOCUMENTS

| | | | |
|---|---|---|---|
| JP | 56009676 | | 1/1981 |
| JP | 82 00213 | | 8/1996 |
| JP | 82 19017 | | 8/1996 |
| JP | 09-112416 | | 5/1997 |
| JP | 09-209922 | | 8/1997 |
| JP | 11-199849 | | 7/1999 |
| JP | 2000245126 | A * | 9/2000 |
| WO | WO 02/93719 | A1 * | 11/2002 |
| WO | WO02/093719 | A1 * | 11/2002 |

* cited by examiner

RELIABILITY-IMPROVING STRUCTURE OF RECIPROCATING COMPRESSOR

TECHNICAL FIELD

The present invention relates to a reciprocating compressor, and in particular to a reliability-improving structure of a reciprocating compressor capable of minimizing vibration noise occurred in operation, adjusting a quantity of compression gas accurately, measuring an air gap in order to uniform an air gap of a reciprocating motor of the reciprocating compressor and firming combination between an inner stator which is combined with a piston for compressing gas and performs a linear reciprocating motion with the piston and a magnet fixedly combined with the inner stator.

BACKGROUND ART

In general, a reciprocating compressor is for compressing fluid such as air or coolant gas, etc. A compressor includes a motor part installed in a sealed container and generating a driving force and a compression unit for sucking and compressing coolant gas by receiving the driving force of the motor.

The compressor is divided into a rotary compressor, a reciprocating compressor and a scroll compressor, etc. according to a gas compression mechanism of the motor part and compression part.

As depicted in FIG. 1, in the rotary compressor, according to rotation of a rotor 2 of a motor part M installed in a sealed container 1, a rotational shaft 3 inserted into the rotor 2 is rotated. By the rotation of the rotational shaft 3, a rolling piston 5 inserted into an eccentric portion 3*a* of the rotational shaft 3 and arranged in a compression space P of a cylinder 4 contacts to the inner circumference of the compression space P of the cylinder 4. In that contact state, with a vane (not shown) inserted into a certain side of the cylinder 4 in order to divide a high pressure region and a low pressure region, the rolling piston 5 compresses the coolant gas sucked into a suction hole 4*a* of the cylinder 4 and discharges the gas through a discharge flow path while being rotated in the compression space P of the cylinder 4, and the operation is performed repeatedly.

As depicted in FIG. 2, in the reciprocating compressor, a crank shaft 13 inserted into a rotor 12 is rotated according to rotation of the rotor 12 of a motor part M installed in a sealed container 11. By the rotation of the crank shaft 13, a piston 14 combined with an eccentric portion 13*a* of the crank shaft 13 compresses coolant gas sucked through a valve assembly 16 combined with the cylinder 15 and discharges the gas through the valve assembly 16 while performing a linear reciprocating motion inside a compression space P of a cylinder 15, and the operation is performed repeatedly.

And, as depicted in FIG. 3, in the scroll compressor, a rotational shaft 23 having an eccentric portion 23*a* inserted into a rotor 22 is rotated according to rotation of the rotor 22 of a motor part M installed in a sealed container 21. According to the rotation of the rotational shaft 23, because a slewing scroll 24 connected to the eccentric portion 23*a* of the rotational shaft 23 performs a slewing motion while being engaged with a fixed scroll 25, volume of plural compression pockets formed by involute-curved wraps 24*a*, 25*a* respectively formed at the slewing scroll 24 and the fixed scroll 25 is decreased, and accordingly coolant gas is sucked, is compressed and is discharged in the operation. The operation is performed repeatedly.

Hereinafter, the rotary compressor, the reciprocating compressor and the scroll compressor operated by different compression mechanisms will be described in the structure and reliability aspects.

First, in the structure aspect of the rotary compressor, the rotary compressor includes the rotational shaft 3 having the eccentric portion 3*a*, the rolling piston 5 inserted into the eccentric portion 3*a* and plural balance weights combined with the rotor 2 so as to maintain the rotation balance of the eccentric portion 3*a*. Because the rotary compressor has lots of construction parts, a structure thereof is a little complicate.

In addition, in the reliability aspect of the rotary compressor, because the eccentric portion 3*a* formed at the rotational shaft 3 and the rolling piston 5 are rotated eccentrically, lots of vibration noise occurs in rotation.

And, in the structure aspect of the reciprocating compressor, the reciprocating compressor includes the crank shaft 13 having the eccentric portion 13*a*, the piston 14 combined with the crank shaft 13 and a balance weight 13*b* for maintaining the rotation balance of the eccentric portion 13*a*. Because the reciprocating compressor has lots of construction parts, a structure thereof is a little complicate.

In addition, in the reliability aspect of the reciprocating compressor, because the eccentric portion 13*a* formed at the crank shaft 13 is rotated eccentrically, vibration noise occurs, in addition, the valve assembly 16 is operated in suction and discharge, lots of suction/discharge noise occurs.

And, in the structure aspect of the scroll compressor, the scroll compressor includes the rotational shaft 23 having the eccentric portion 23*a*, the slewing scroll 24 and the fixed scroll 25 having the involute-curved wraps and a balance weight for maintaining the rotation balance of the eccentric portion 23*a*. Because it has lots of construction parts, a structure thereof is very complicate. In addition, it is very difficult to fabricate the slewing scroll 24 and the fixed scroll 25.

In addition, in the reliability aspect of the rotary scroll, vibration noise occurs in the slewing motion of the slewing scroll 24 and the eccentric motion of the eccentric portion 23*a* formed at the rotational shaft 23.

As described above, in the rotary compressor, the reciprocating compressor and the scroll compressor, the compression part compresses gas by receiving the rotational force of the motor part, when a compressor is installed in a cooling cycle, the number of rotations of the motor part has to be reduced or the rotation of the motor part has to be stopped in order to adjust a quantity of compression gas, and accordingly it is difficult to adjust a quantity of the compression gas accurately.

In addition, by respectively forming the eccentric portion 3*a*, 13*a*, 23*a* at the rotational shaft rotated by receiving the rotational force of the motor part, the balance weight 6, 13*b*, 26 are required, lots of driving force is consumed, vibration noise occurs in the operation, and accordingly reliability of the compressor is lowered. In addition, because of complicated structure, assembly productivity is lowered.

TECHNICAL GIST OF THE PRESENT INVENTION

In order to solve the above-described problems, it is an object of the present invention to provide a reciprocating compressor which is capable of minimizing vibration noise in operation, adjusting a quantity of compression gas accurately and improving a compression performance.

In addition, it is another object of the present invention to provide a reciprocating compressor which is capable of simplifying assembly of construction parts and minimizing assembly error.

It is yet another object of the present invention to provide a reciprocating compressor which is capable of measuring an air gap of a reciprocating motor in order to uniform an air gap of the reciprocating motor in an assembly process.

And, it is still another object of the present invention to provide a reciprocating compressor which is capable of constructing a reciprocating motor generating a linear reciprocating driving force; and combining firmly an inner stator combined with a piston so as to perform a linear reciprocating motion along the piston with a magnet fixed to the inner stator.

In order to achieve the above-mentioned objects, a reliability-improving structure of a reciprocating compressor in accordance with the present invention includes a container having a suction pipe in which gas is sucked; an outer stator disposed in the container, and an inner stator inserted into the outer stator so as to be movable; a reciprocating motor having a magnet fixedly combined with the inner stator so as to place between the inner stator and the outer stator; a front frame having a cylinder unit at which a through hole is formed and combined so as to support the outer stator of the reciprocating motor; a piston inserted into the through hole of the cylinder unit of the front frame, combined with the inner stator of the reciprocating motor, receiving a linear reciprocating driving force of the reciprocating motor and performing a linear reciprocating motion with the inner stator and the magnet; a rear frame unit for covering the piston and fixedly supporting the reciprocating motor; a resonance spring unit for supporting movement of the piston, the inner stator and the magnet elastically; and a valve unit for sucking and discharging gas according to the linear reciprocating motion of the piston.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, the preferred embodiments of a reliability-improving structure of a reciprocating compressor in accordance with the present invention will be described in detail with reference to accompanying drawings.

Figure 1:
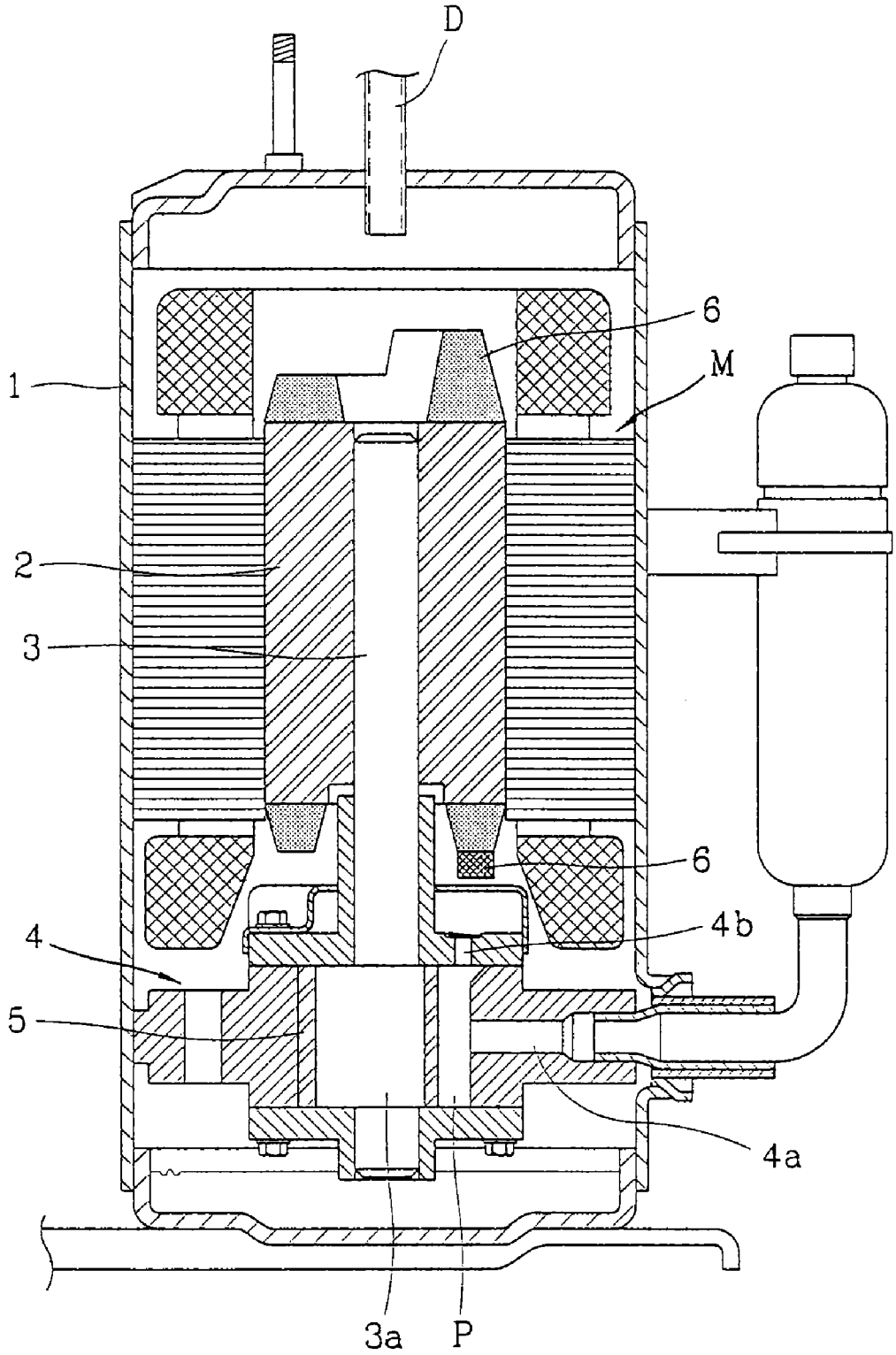
FIG. 1 (Prior Art)
FIG. 1 is a sectional view illustrating the conventional rotary compressor.
Figure 2:
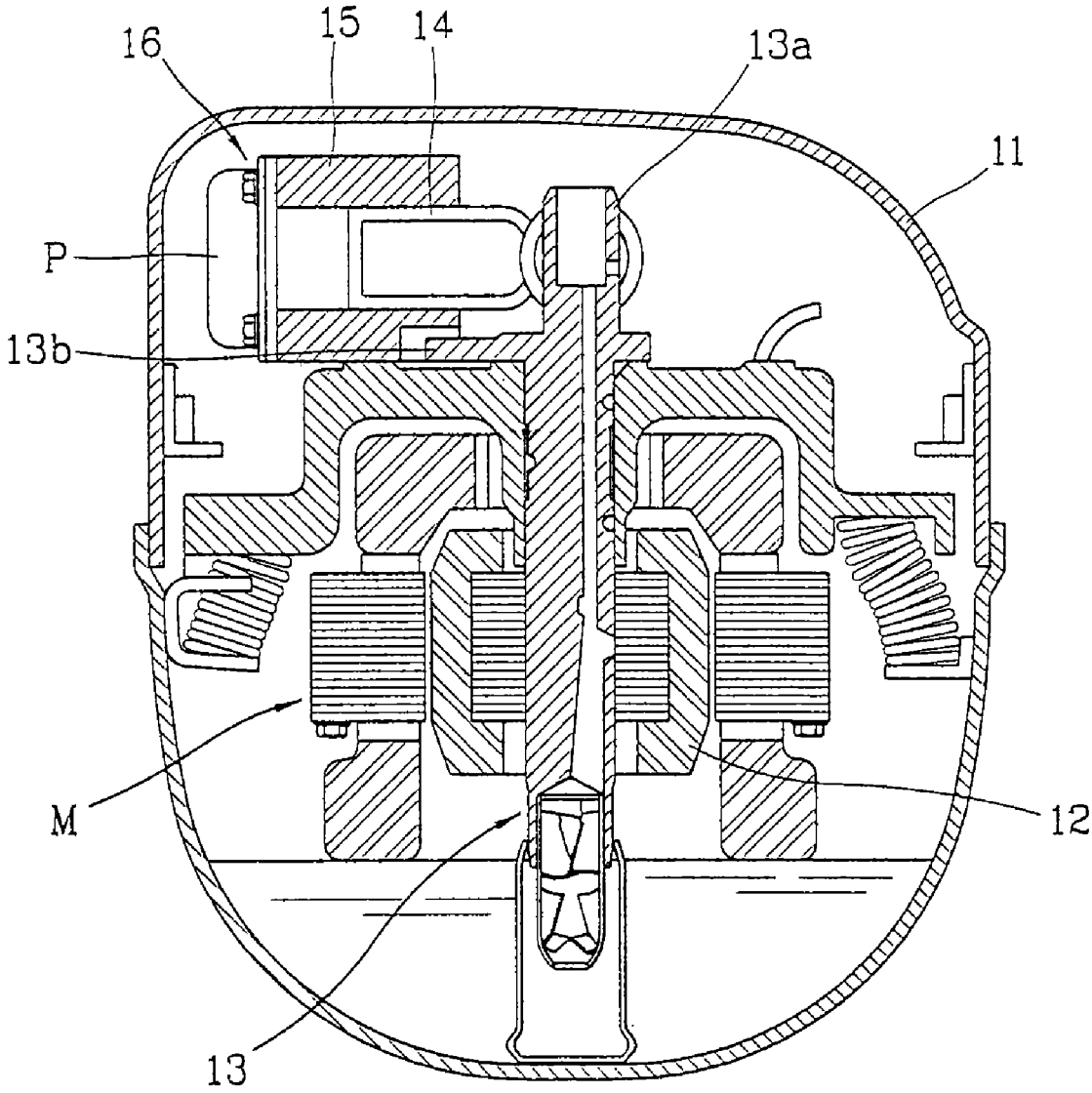
FIG. 2 (Prior Art)
FIG. 2 is a sectional view illustrating the conventional reciprocating compressor.
Figure 3:
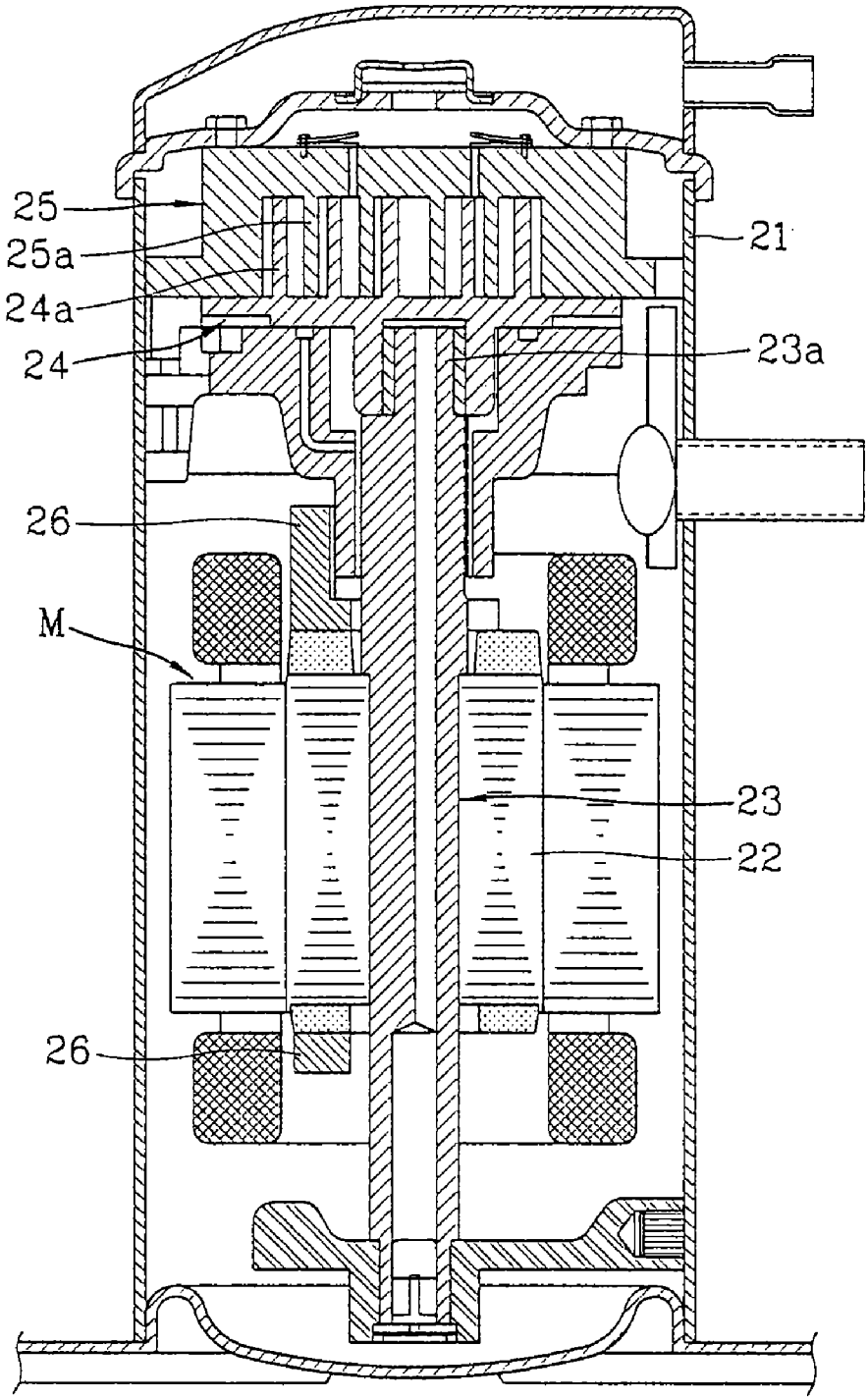
FIG. 3 (Prior Art)
FIG. 3 is a sectional view illustrating the conventional scroll compressor.
Figure 4:
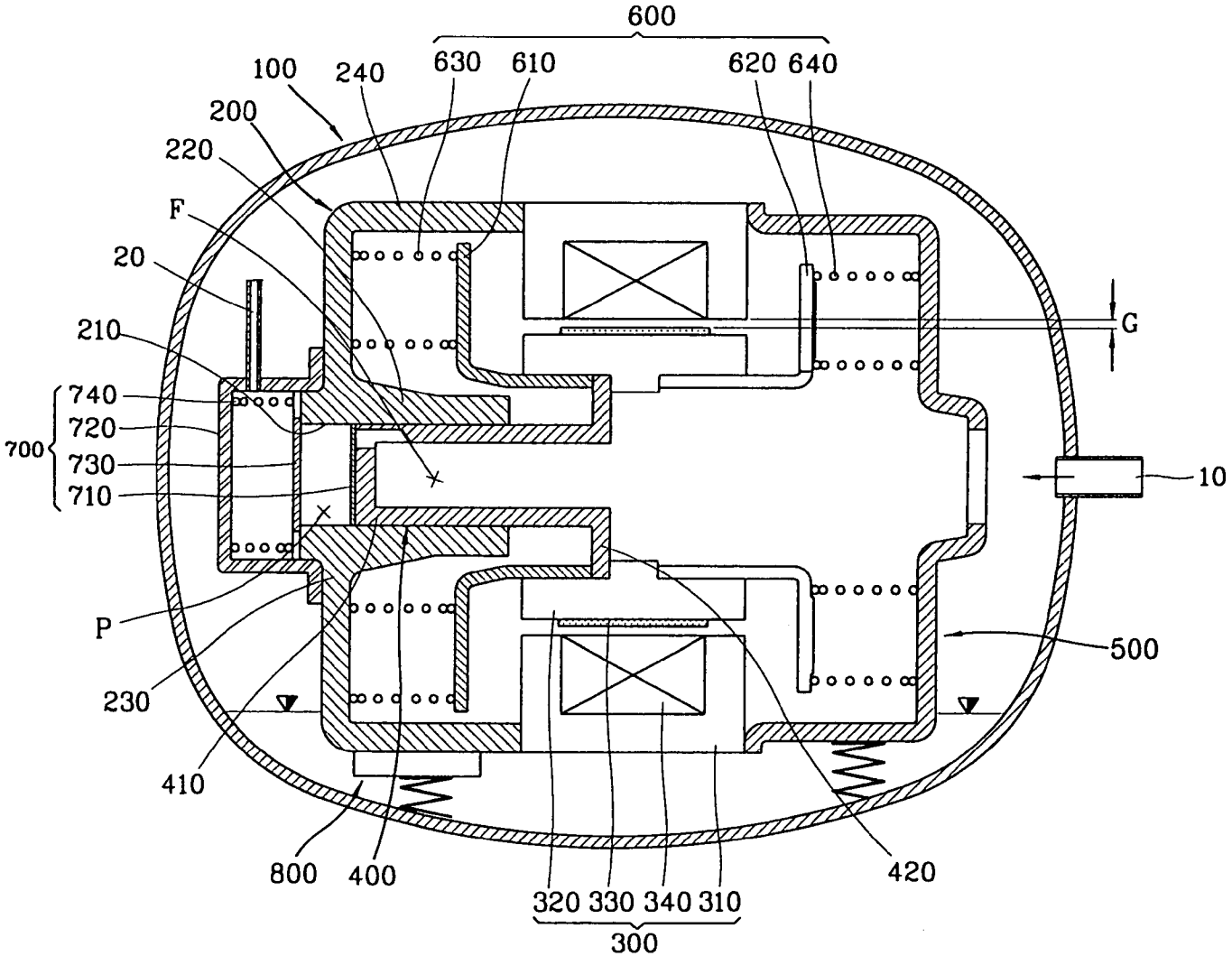
FIG. 4 is a sectional view illustrating an embodiment of a reliability-improving structure of a reciprocating compressor in accordance with the present invention.

First, FIG. 4 is a sectional view illustrating an embodiment of a reliability-improving structure of a reciprocating compressor in accordance with the present invention. As depicted in FIG. 4, in the reciprocating compressor, a suction pipe in which gas is sucked is combined with a certain side of a container 100, and the bottom surface of the container 100 is filled with oil.

And, a front frame 200 having a certain shape is arranged in the container 100, a reciprocating motor 300 for generating a linear reciprocating driving force is fixedly combined with the front frame 200, and a certain-shaped rear frame unit 500 is combined with the other side of the reciprocating motor 300 so as to support it.

In the front frame 200, a plate portion 230 having a certain area is extended-formed from a side of a cylinder unit 220 having a through hole 210, and a support portion 240 is curved-extended from the plate portion 230.

A reciprocating motor 300 includes an outer stator 310 consisting of a cylindrical laminated body and a wound coil 340 combined with the laminated body; a cylindrical inner stator 320 inserted into the outer stator 310 in the length direction so as to perform a linear reciprocating motion; and a magnet 330 fixedly combined with the inner stator 320 so as to place between the outer stator 310 and the inner stator 320.

Figure 5:
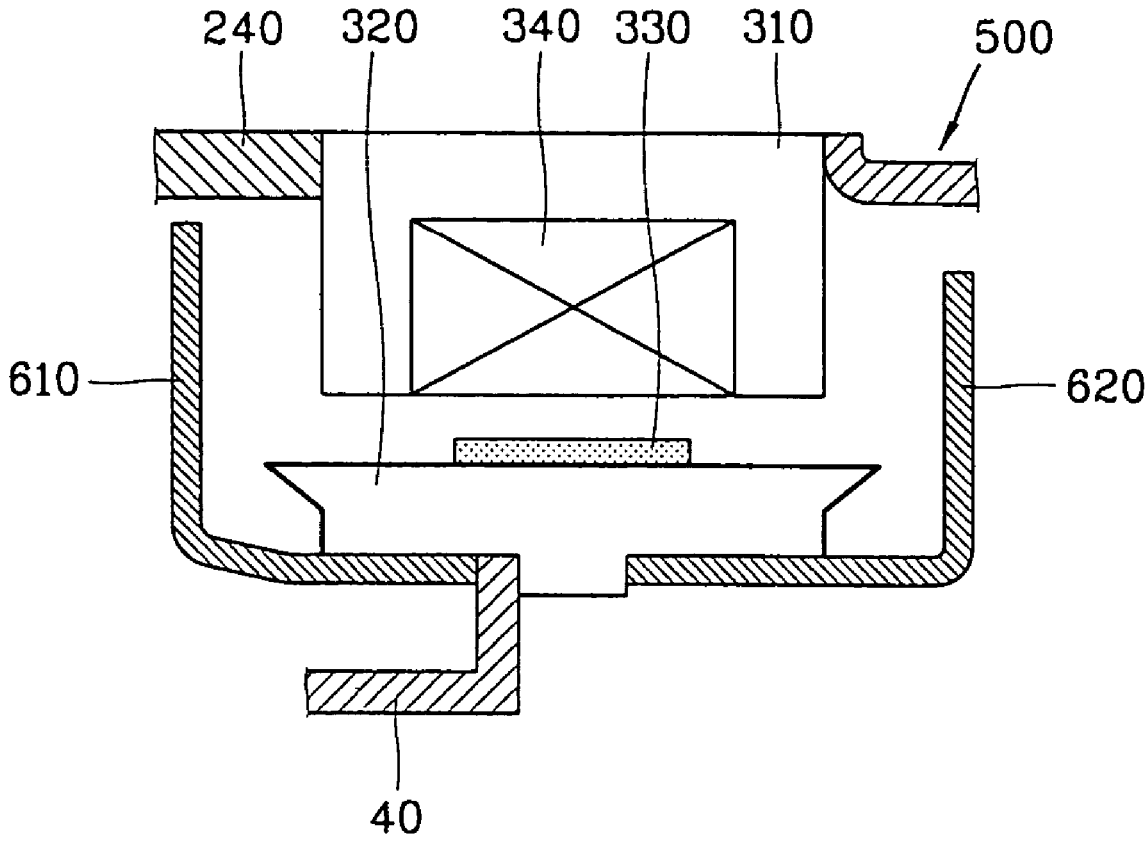
FIG. 5 is an enlarged-sectional view illustrating a motor part of the compressor in FIG. 4.

In more detail, the inner stator 320 and the magnet 330 are fixedly combined with each other as one body. As depicted in FIG. 5, a length of the inner stator 320 is longer than that of the outer stator 310. In other words, the both ends of the inner stator 320 are extended more than the both ends of the outer stator 310. Because of that, a smooth flux path is secured between the inner stator 320 at which the magnet 330 is fixedly combined and the outer stator 310, and accordingly operation reliability of the reciprocating compressor can be improved.

In the reciprocating motor 300, the outer stator 310 is fixedly combined with the support portion 240 of the front frame 200.

And, the certain-shaped piston 400 is inserted into the through hole 210 of the cylinder unit 220 of the front frame 200 and is combined with the inner stator 320 of the reciprocating motor 300.

The cylindrical-shaped piston 400 includes a piston body portion 410 having an inner gas flow path F and a ring-shaped flange portion 420 curved-extended from the end of the piston body portion 410. The piston body portion 410 is inserted into the cylinder unit through hole 210 of the front frame 200, and the flange portion 420 is fixedly combined with the inner stator 320.

A compression space P is formed by the cylinder unit through hole 210 of the front frame 200 and the piston 400.

The rear frame unit 500 has a cap shape and is fixedly combined with the outer stator 310 of the reciprocating motor 300 so as to cover the piston 400, the inner stator 320 and the magnet 330.

And, a resonance spring unit 600 is included in order to support the movement of the piston 400, the inner stator 320 and the magnet 330 elastically.

The resonance spring unit 600 includes a certain-shaped first spring supporter 610 fixedly combined with the inner stator 320 and the piston 400 so as to place at the front frame side; a second spring supporter 620 fixedly combined with the other side of the inner stator 320 so as to place at the rear frame unit side; a first spring 630 placed between the first spring supporter 610 and the front frame 200; and a second spring 640 placed between the second spring supporter 610 and the rear frame unit 500.

It is preferable to form the first and second springs 630, 640 as coil springs.

And, a valve unit 700 is included in order to suck and discharge gas according to the linear reciprocating motion of the piston 400.

The valve unit 700 includes a suction valve 710 fixedly combined with the end of the piston 400 and opening/closing the gas flow path F of the piston 400; a discharge cover 720 for covering the cylinder unit through hole 210 of the front frame 200; a discharge valve 730 placed inside the discharge cover 720 and opening/closing the through hole 210 of the front frame 200; and a valve spring 740 placed inside the discharge cover 720 and elastically supporting the discharge valve 730.

A discharge pipe 20 for discharging gas is combined with a side of the discharge valve 730.

And, an oil supply means 800 is arranged at the lower portion of the front frame 200, the sucked oil is supplied to each portion at which friction occurs by the oil supply means 800.

Figure 6:
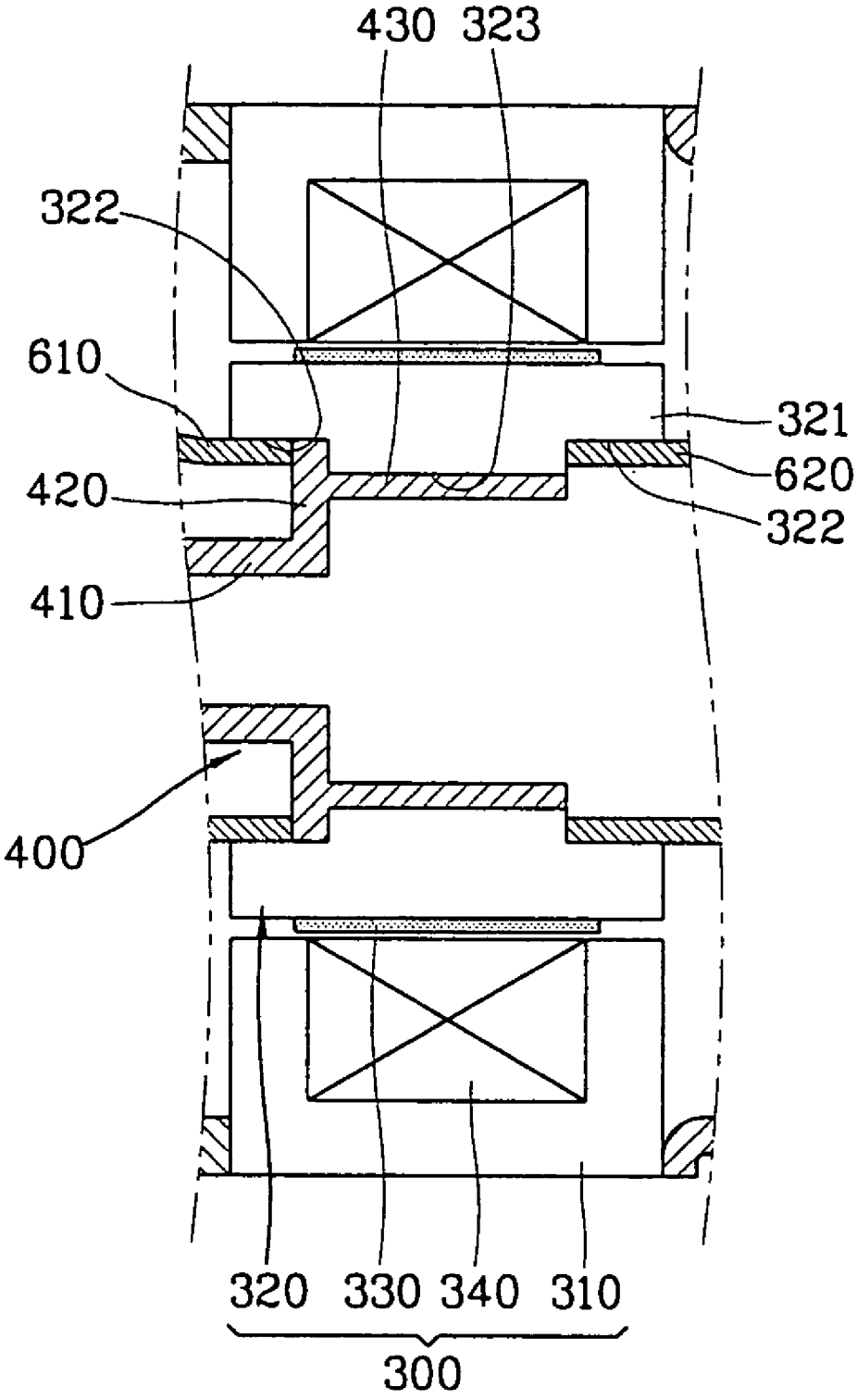
FIG. 6 is a sectional view illustrating a modified combination of a piston and an inner stator of the reciprocating compressor in accordance with the embodiment of the present invention.

In the meantime, in a modified combination of a piston and an inner stator of the reciprocating compressor in accordance with the embodiment of the present invention shown in FIG. 6, the piston 400 includes a piston body portion 410 having a certain length and arranged in the compression space P; a flange portion 420 curved-formed at the end of the piston body portion 410 so as to have a certain area; and a fixed guide portion 430 extended-formed at a surface of the flange portion 420 so as to have a certain outer diameter and a length in the axial direction.

And, the inner stator 320 includes a cylindrical body 321; a first combining portion 322 formed inside the cylindrical body 321 so as to have an inner diameter corresponded to the outer diameter of the flange portion 420 of the piston 400; and a second combining portion 323 abutting on the first combining portion 322 and pierced-formed through the cylindrical body 321 so as to have an inner diameter corresponded to the outer diameter of the fixed guide portion 430 of the piston 400.

And, the first combining portion 322 of the inner stator 320 is fixedly inserted into the flange portion 420 of the piston 400, and the second combining portion 323 is fixedly combined with the fixed guide portion 430 of the piston 400.

And, a side of the first spring supporter 610 and a side of the second spring supporter 620 are inserted into the first combining portion 32 of the inner stator 320.

In the meantime, as depicted in FIG. 4, in the construction of the reciprocating motor for generating the linear reciprocating driving force, an air gap G is one of factors determining efficiency of the motor.

In more detail, when the air gap G is big, efficiency of the motor is lowered due to flux loss, when the air gap G is small, efficiency of the motor is improved. However, when the air gap G is small, an assembly process is intricate, and damage of construction parts may occur because contact between other construction parts.

In more detail, with the above-mentioned structure of the reciprocating compressor, when the air gap G of the reciprocating motor is minimized and whole construction parts are assembled in that state, due to fabrication error and assembly error of the construction parts, the air gap G of the reciprocating motor can not be maintained uniformly, interference between the construction parts may occur, and accordingly reliability of the reciprocating compressor may be lowered.

Accordingly, a remedy for the above-mentioned problem will be presented.

Figure 7:
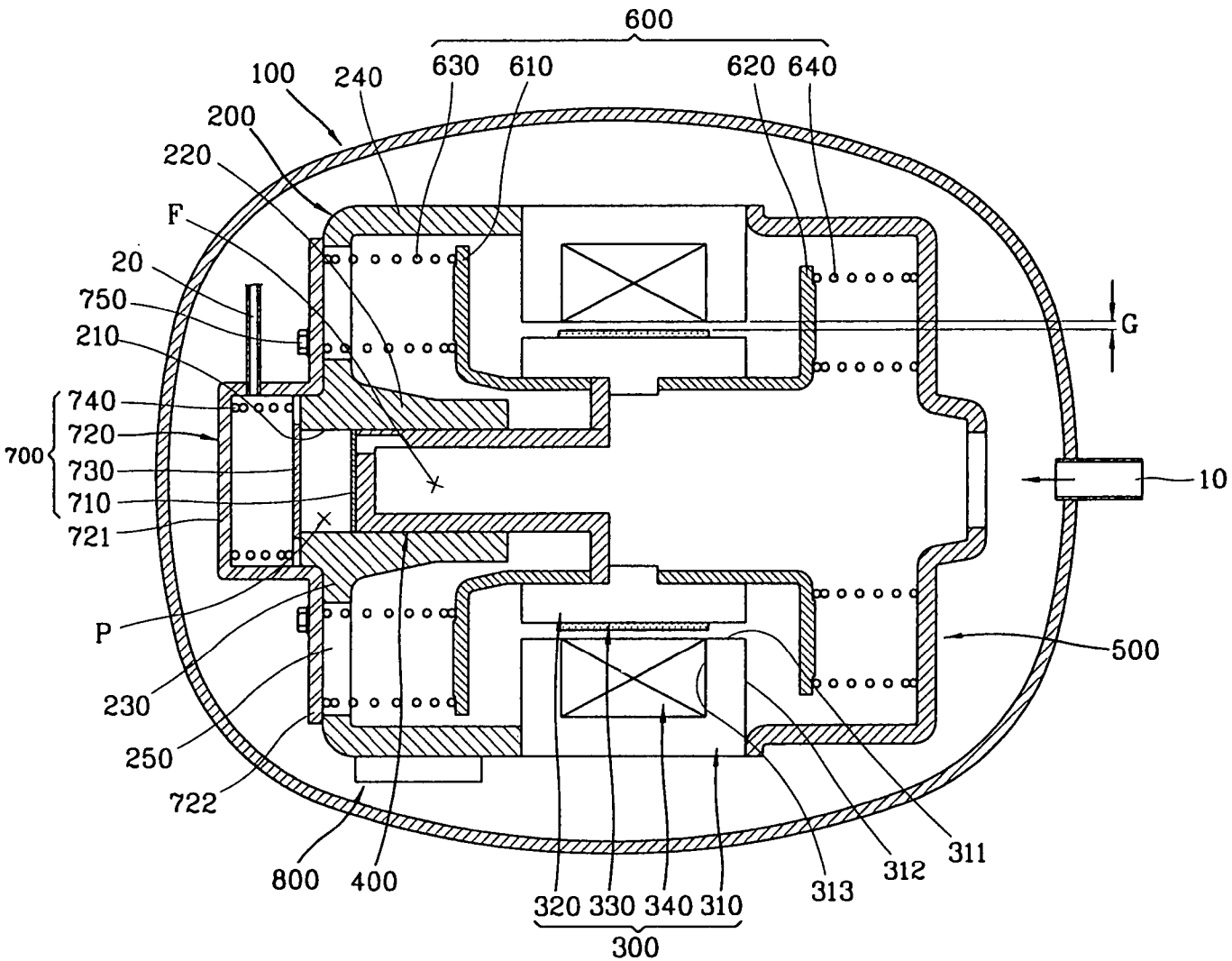
FIG. 7 is a sectional view illustrating another embodiment of a reliability-improving structure of a reciprocating compressor in accordance with the present invention.

FIG. 7 is a sectional view illustrating another embodiment of a reliability-improving structure of a reciprocating compressor in accordance with the present invention. As depicted in FIG. 7, in the reciprocating compressor, a suction pipe 10 in which gas is sucked is combined with a side of a certain-shaped container 100.

And, a front frame 200 having a certain shape is installed in the container 100, a reciprocating motor 300 for generating a linear reciprocating driving force is fixedly combined with the front frame 200, and a certain-shaped rear frame unit 500 is combined with the other side of the reciprocating motor 300 so as to support it.

In the front frame 200, a plate portion 230 having a certain area is extended-formed from a side of a cylinder unit 220 having a through hole 210, a support portion 240 is curved-extended from the plate portion 230, and plural measuring holes 250 are pierced through the plate portion 240. The plural measuring holes 250 formed at the plate portion 240 are placed on the same circle.

A compression space P is formed by the through hole 210 of the cylinder unit 220 of the front frame 200 and the piston 400.

A reciprocating motor 300 includes an outer stator 310 consisting of a cylindrical laminated body and a wound coil 340 combined with the laminated body; a cylindrical inner stator 320 inserted into the outer stator 310 in the length direction so as to perform a linear reciprocating motion; and a magnet 330 fixedly combined with the inner stator 320 so as to place between the outer stator 310 and the inner stator 320.

The outer stator 310 is a laminated body 312 in which certain-shaped plural thin plates are laminated, it has an inner through hole 311, and the wound coil 340 is combined with an opening groove 313 formed at the inner circumference of the through hole 311.

The inner stator 320 is a laminated body in which plural thin plates are laminated radially as a cylindrical shape, and the magnet 330 is fixedly combined with the outer circumference of the inner stator 320 so as to place between the outer stator 310 and the inner stator 320.

An interval between the outer surface of the magnet 330 and the inner circumference of the outer stator 310 is called the air gap G.

A length of the inner stator 320 is longer than that of the outer stator 140, and the outer stator 310 is fixedly combined with the support portion 240 of the front frame 200.

The rear frame unit 500 has a cap shape and is fixedly combined with the outer stator 310 of the reciprocating motor 300 so as to cover the piston 400, the inner stator 320 and the magnet 330.

And, a resonance spring unit 600 is included in order to support the movement of the piston 400, the inner stator 320 and the magnet 330 elastically.

The resonance spring unit 600 includes a certain-shaped first spring supporter 610 fixedly combined with the inner stator 320 and the piston 400 so as to place at the front frame side; a second spring supporter 62—fixedly combined with the other side of the inner stator 320 so as to place at the rear frame unit side; a first spring 630 placed between the first spring supporter 610 and the front frame 200; and a second spring 640 placed between the second spring supporter 610 and the rear frame unit 500.

And, a valve unit 700 is included in order to suck and discharge gas according to the linear reciprocating motion of the piston 400.

The valve unit 700 includes a suction valve 710 fixedly combined with the end of the piston 400 and opening/closing the gas flow path F of the piston 400; and a discharge cover 720 for covering the cylinder unit through hole 210 of the front frame 200 is fixedly combined with the front frame 200 by plural fastening bolts 750.

The discharge cover 720 includes a cover portion 721 having a cap shape and an extended portion 722 curved-extended from the end of the cover portion 721. In the discharge cover 720, when the cover portion 721 covers the through hole 210 of the front frame 200 and the extended portion 722 contacts with the plate portion 230 of the front frame 200, the plural fastening bolts 750 are pierced-fastened through the extended portion 722, and accordingly the discharge cover 720 is fixedly combined with the front frame 200.

Herein, the extended portion 722 of the discharge cover 720 closes the measuring hole 250 formed at the plate portion 230 of the front frame 200, and it is preferable a side of the first spring 630 is arranged in the measuring hole 250 of the plate portion 230 of the front frame 200 and is supported by the extended portion 722 of the discharge cover 720.

And, a discharge valve 730 for opening/closing the through hole 210 and a valve spring 740 for elastically supporting the discharge valve 730 are inserted into the cover portion 721 of the discharge cover 720.

In the meantime, fixing of the inner stator 310 constructing the reciprocating motor 300 and performing the reciprocating motion together with the piston 400 by being connected to it and the magnet 330 fixedly combined with the inner stator 310 will be described in detail.

First, the inner stator 320 has the cylindrical shape so as to be inserted into the outer stator 310 with a certain interval, the magnet 330 is formed so as to have a certain thickness and area, and the magnet 330 is adhered to the outer circumference of the inner stator 320 by an adhesive agent.

However, in the above-described structure, because the magnet 330 is adhered to the outer circumference of the inner stator 320 by the adhesive agent, when the inner stator 320 and the magnet 330 perform the linear reciprocating motion together with the piston 400 in the axial direction by being elastically supported by the spring unit 600, the magnet 300 may be separated from the inner stator 320 and cause damage due to operation vibration or a long term operation, and accordingly reliability of the reciprocating compressor may be lowered.

Hereinafter, a remedy for the problem will be presented.

Figure 9:
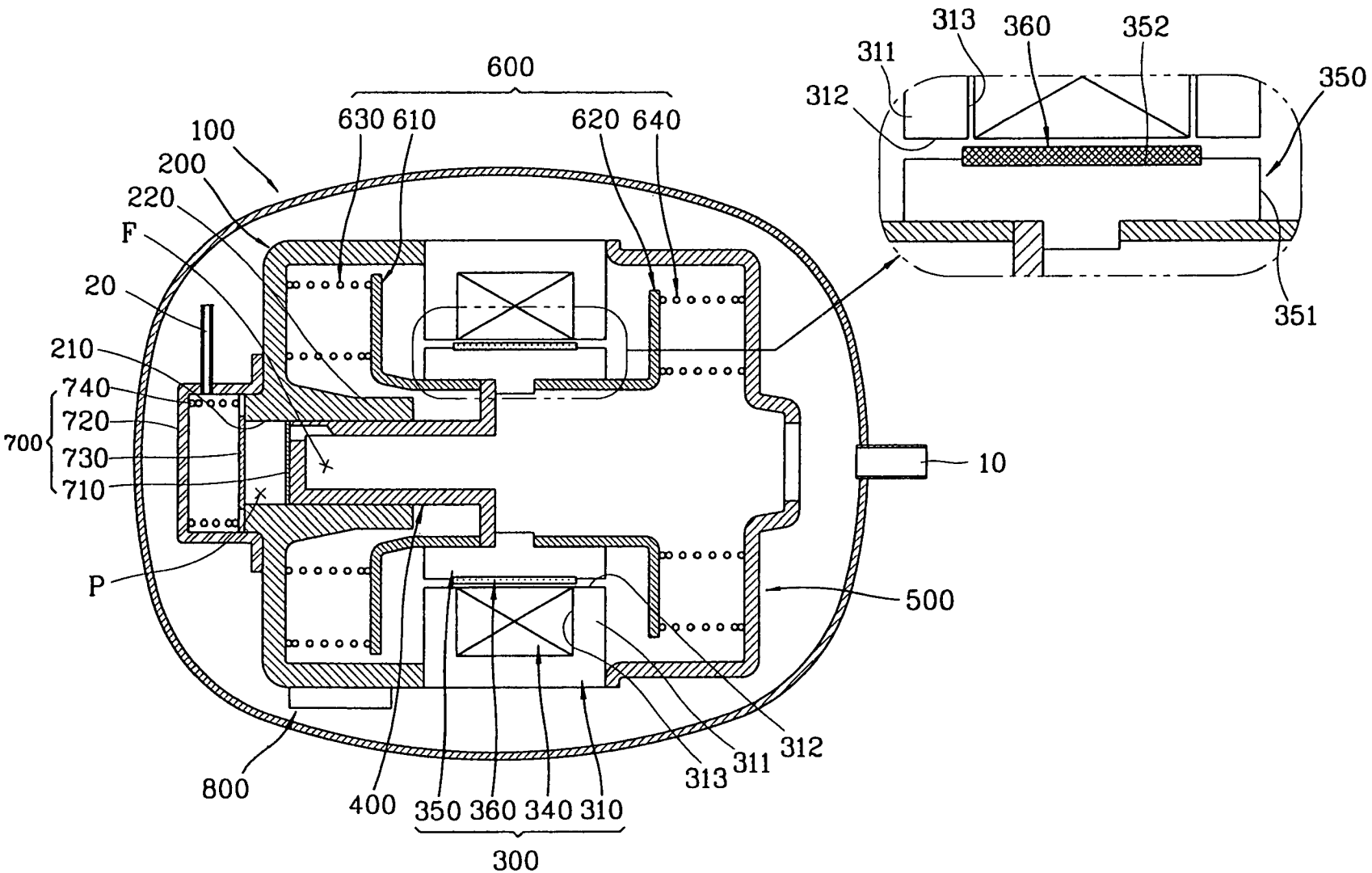
FIG. 9 is a sectional view illustrating yet another embodiment of a reliability-improving structure of a reciprocating compressor in accordance with the present invention.

FIG. 9 is a sectional view illustrating yet another embodiment of a reliability-improving structure of a reciprocating compressor in accordance with the present invention. As depicted in FIG. 9, the reciprocating compressor includes a container 100 having a suction pipe 10; a front frame 200 having a cylinder unit 220 at which a through hole 210 is formed and arranged inside the container 100; a reciprocating motor 300 in which an inner stator 350 is inserted so as to be movable inside an outer stator 310 fixedly combined with a side of the front frame 200 in the axial direction and a magnet 360 is combined with the inner stator 350 so as to be placed between the inner stator 350 and the outer stator 310; a piston 400 inserted into the through hole 210 of the cylinder unit 200 of the front frame 200, combined with the inner stator 350 of the reciprocating motor 300 and performing a linear reciprocating motion with the inner stator 350 and the magnet 360 by receiving a linear reciprocating driving force of the reciprocating motor 300; a rear frame unit 500 for converting the piston 400 and fixedly supporting the outer stator 310 of the reciprocating motor 300; a resonance spring unit 600 for elastically supporting the movement of the piston 400, the inner stator 310 and the magnet 360; and a valve unit 700 for sucking and discharging gas according to the linear reciprocating motion of the piston 400.

The outer stator 310 of the reciprocating motor 300 includes a cylindrical body 311 having a certain length and a through hole 310 formed inside the cylindrical body 311, an opening groove 313 having a certain width and depth is formed at the inner circumference of the through hole 312 of the cylindrical body 311, and a wound coil 340 is combined with the opening groove 313.

The inner stator 350 consists of a cylindrical body 351 having a length longer than that of the outer stator 310, is inserted into the through hole 312 of the outer stator 310 with a certain interval, and the piston 400 is combined with the cylindrical body 351.

In more detail, a certain interval is maintained between the inner circumference of the cylindrical body 311 of the outer stator 310 and the outer circumference of the cylindrical body 351 of the inner stator 350.

And, the magnet 360 is fixedly combined with the inner stator 350 so as to place between the outer stator 310 and the inner stator 350.

The magnet 360 consists of plural magnets, and they are arranged on the outer circumference of the inner stator 350 in the circumferential direction at regular intervals.

In fixing of the magnet 360 to the inner stator 350, an installation groove 352 having a certain depth is formed at the outer circumference of the cylindrical body 351 of the inner stator 350, and the magnet 360 is fixedly inserted into the installation groove 352 of the inner stator 350.

The magnet is formed so as to have a certain thickness and area. In more detail, the magnet 360 is formed as a curved plate having a radius curvature corresponded to a radius of curvature of the outer circumference of the inner stator 350. The installation groove 352 of the inner stator 350 has a shape and a depth corresponded to the shape and depth of the magnet 360. The magnet 360 can be fixedly inserted into the installation groove 352 or adhered to the installation groove 352 by an adhesive agent.

Figure 10:
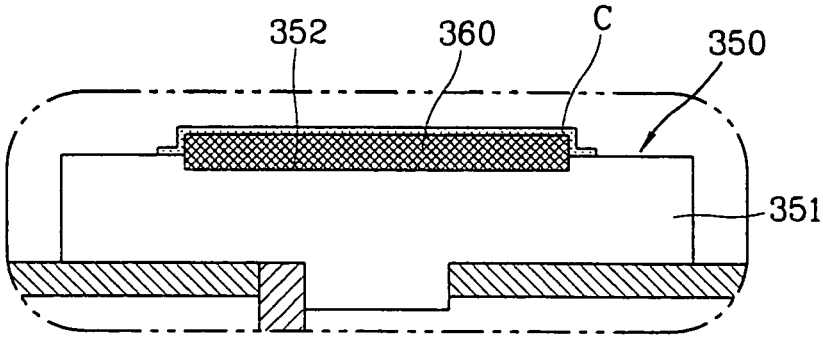
FIG. 10 is a sectional view illustrating a different example of yet another embodiment of the reliability-improving structure of the reciprocating compressor in accordance with the present invention.

And, as depicted in FIG. 10, when the magnet 360 is inserted into the installation groove 352, the magnet 360 can be fixed to the inner stator 350 by hardening carbon fiber C onto part of the outer circumference of the inner stator 350 including the magnet 360.

And, in a modified example of the installation groove 352, the installation groove 352 is formed as a circular band shape onto the outer circumference of the inner stator 350 in the circumferential direction so as to have a length and a depth corresponded to the magnet 360, and the magnet 360 is fixedly inserted into the installation groove 352 at regular intervals.

Figure 11:
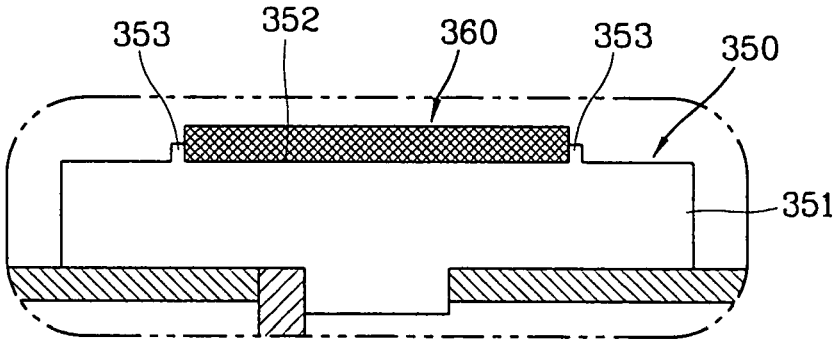
FIG. 11 is a sectional view illustrating a different example of yet another embodiment of the reliability-improving structure of the reciprocating compressor in accordance with the present invention.

In a different example of yet another embodiment of the reliability-improving structure of the reciprocating compressor in accordance with the present invention shown in FIG. 11, the installation groove 352 in which the magnet 360 is fixedly inserted is formed at the outer circumference of the cylindrical body 351, and a protrusion 353 is respectively formed on the outer circumference of the cylindrical body 351 so as to have a length and an interval corresponded to the magnet 360.

The protrusion 353 is projected-extended from the outer circumference of the cylindrical body 351 of the inner stator 350 so as to have a certain thickness and a height.

The magnet 360 is formed as a curved plate having a radius curvature corresponded to a radius of curvature of the outer circumference of the inner stator 350 and is fixedly inserted into the installation groove 352 formed by the protrusions 353.

Figure 12:
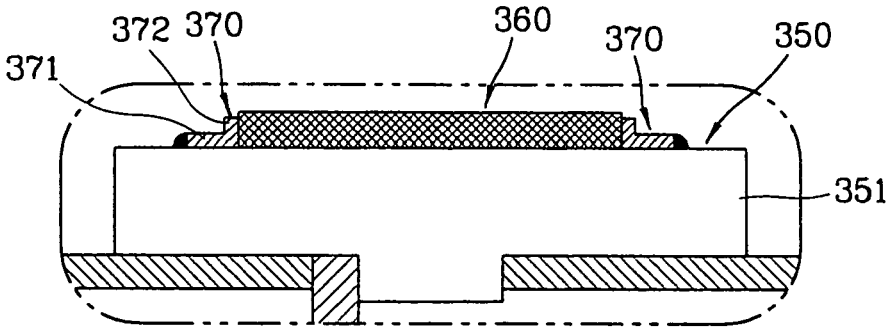
FIG. 12 is a sectional view illustrating a different example of yet another embodiment of the reliability-improving structure of the reciprocating compressor in accordance with the present invention.

In a different example of yet another embodiment of the reliability-improving structure of the reciprocating compressor in accordance with the present invention shown in FIG. 12, the magnet 360 is contacted to the outer circumference of the inner stator 350 so as to place between the outer stator 310 and the inner stator 350, and a certain-shaped magnet fixing member 370 is fixedly combined with the inner stator 350 and fixes the magnet 360.

The magnet 360 has a certain thickness and area, and it is formed as a curved plate having a radius curvature corresponded to a radius of curvature of the outer circumference of the inner stator 350.

And, the magnet fixing member 370 includes a horizontal contact portion 371 contacted and joined to the outer circumference of the inner stator 350; and a vertical portion 372 curved-extended from the horizontal contact portion 371 so as to be shorter than a height of the magnet 360 and supporting the side surface of the magnet 360. The magnet fixing member 370 is respectively combined with the both sides of the magnet 360 in the length direction in order to support the magnet 360.

The magnet fixing member 370 having a length corresponded to a length of the magnet 360 in the long axis direction is fixedly combined with the both sides of each magnet 360, or the magnet fixing member 370 is formed as a circular shape in order to fix-combine collectively the magnets 360 arranged on the outer circumference of the inner stator 350 in the circumferential direction.

Figure 13:
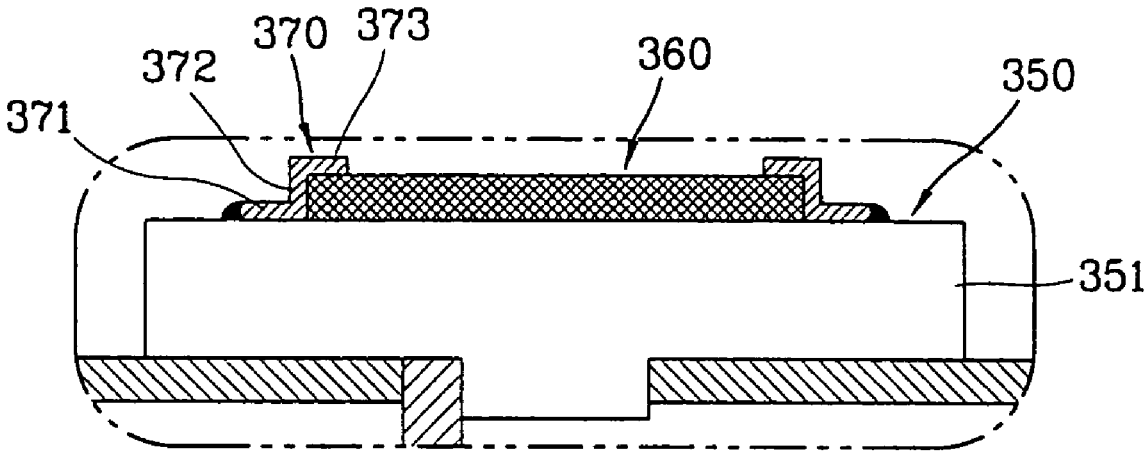
FIG. 13 is a sectional view illustrating a different example of yet another embodiment of the reliability-improving structure of the reciprocating compressor in accordance with the present invention.

In a different example of yet another embodiment of the reliability-improving structure of the reciprocating compressor in accordance with the present invention shown in FIG. 13, the magnet 360 is contacted to the outer circumference of the inner stator 350 so as to place between the outer stator 310 and the inner stator, and a certain-shaped magnet fixing member 370 is fixedly combined with the inner stator 350 and fixes the magnet 360.

The magnet 360 has a certain thickness and area, and it is formed as a curved plate having a radius curvature corresponded to a radius of curvature of the outer circumference of the inner stator 350.

And, the magnet fixing member 370 includes a horizontal contact portion 371 contacted and joined to the outer circumference of the inner stator 350; a vertical portion 372 curved-extended from the horizontal contact portion 371 so as to be shorter than a height of the magnet 360 and supporting the side surface of the magnet 360; and a horizontal fixing portion 373 curved-extended from the vertical portion 372 and supporting the top surface of the magnet 360. The magnet fixing member 370 is respectively combined with the both sides of the magnet 360 in the length direction in order to support the magnet 360.

The magnet fixing member 370 having a length corresponded to a length of the magnet 360 in the long axis direction is fixedly combined with the both sides of each magnet 360, or the magnet fixing member 370 is formed as a circular shape in order to fix-combine collectively the magnets 360 arranged on the outer circumference of the inner stator 350 in the circumferential direction.

Figure 14:
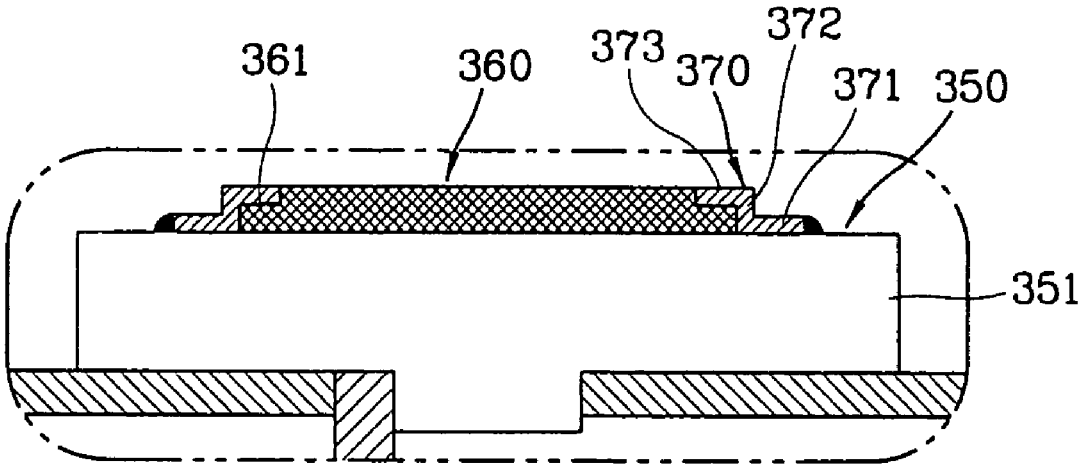
FIG. 14 is a sectional view illustrating a different example of yet another embodiment of the reliability-improving structure of the reciprocating compressor in accordance with the present invention.

In a different example of yet another embodiment of the reliability-improving structure of the reciprocating compressor in accordance with the present invention shown in FIG. 14, a stepped groove 361 corresponded to a thickness of the horizontal fixing portion 373 of the magnet fixing member 370 is formed on the top surface of the magnet 360 arranged so as to contact with the outer circumference of the inner stator 350, the horizontal fixing portion 37 is respectively inserted into the stepped groove 361 of the magnet 360, and accordingly the magnet 360 is fixedly combined.

Herein, the top surface of the magnet 360 and the top surface of the horizontal fixing portion 373 are the same surface.

Figure 15:
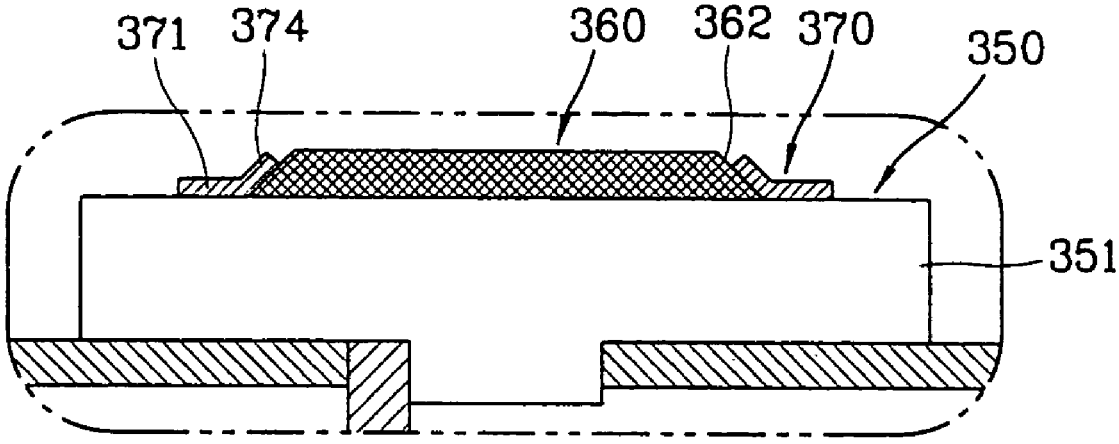
FIG. 15 is a sectional view illustrating a different example of yet another embodiment of the reliability-improving structure of the reciprocating compressor in accordance with the present invention.

In a different example of yet another embodiment of the reliability-improving structure of the reciprocating compressor in accordance with the present invention shown in FIG. 15, the length direction both sides of the magnet 360 contacted to the outer circumference of the inner stator 350 are formed so as to be slant.

And, the magnet fixing member 370 includes a horizontal contact portion 371 contacted and joined to the outer circumference of the inner stator 350; and a slant fixing portion 374 slant-extended from the horizontal contact portion 371 so as to have an angle corresponded to that of a side slant surface 362 of the magnet 360 in order to support the slant surface 362 of the magnet 360.

The magnet fixing member 379 is respectively combined with the outer circumference of the inner stator 350 so as to place on the both sides of the magnet 360 in the long axis direction in order to fix the magnet 360.

It is preferable to join the magnet fixing member 370 onto the outer circumference of the inner stator 350 by welding.

Figure 16:
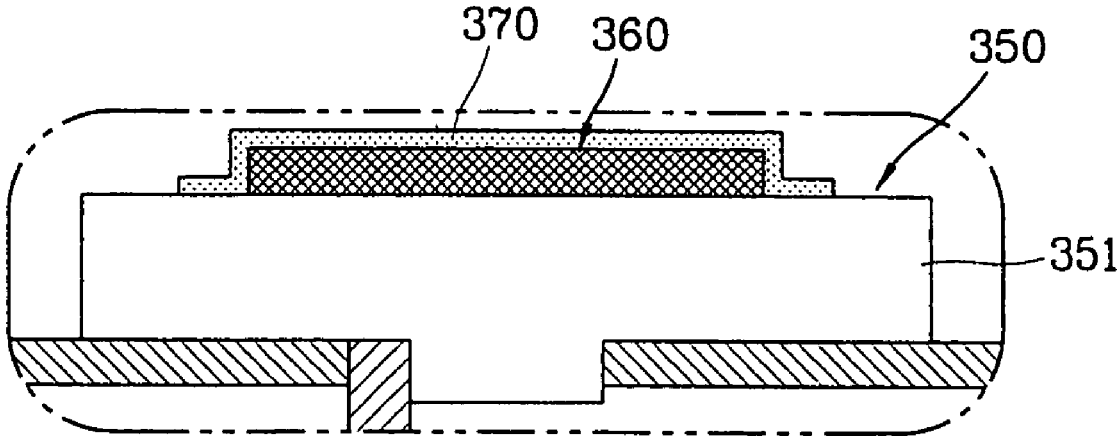
FIG. 16 is a sectional view illustrating a different example of yet another embodiment of the reliability-improving structure of the reciprocating compressor in accordance with the present invention.

In a different example of yet another embodiment of the reliability-improving structure of the reciprocating compressor in accordance with the present invention shown in FIG. 16, plural magnets 360 are arranged on the outer circumference of the inner stator 351 in the circumferential direction.

And, a magnet fixing member 370 for covering not only the magnets 360 but also part of the outer circumference of the inner stator 350 is formed in order to fix the magnets 360.

The magnet fixing member 370 is carbon fiber C. After covering part of the outer circumference of the inner stator 250 including the magnets 360 with the carbon fiber C, the carbon fiber C is hardened.

In the meantime, it is preferable to make the outer stator 310 and the inner stator 350 as laminated bodies by laminating plural thin plates radially in order to make them have a cylindrical shape.

Hereinafter, the operation and advantages of the reliability-improving structure of the reciprocating compressor in accordance with the present invention will be described.

First, when power is applied to the reciprocating compressor, current flows around the wound coil 340 of the reciprocating moor 300, flux is formed between the outer stator 310 and the inner stator 320, and the inner stator 320 and the magnets 330, 360 generate a linear reciprocating driving force by mutual operation between the flux of the outer stator 310 and the inner stator 320 and flux of the magnets 330, 360.

Figure 17:
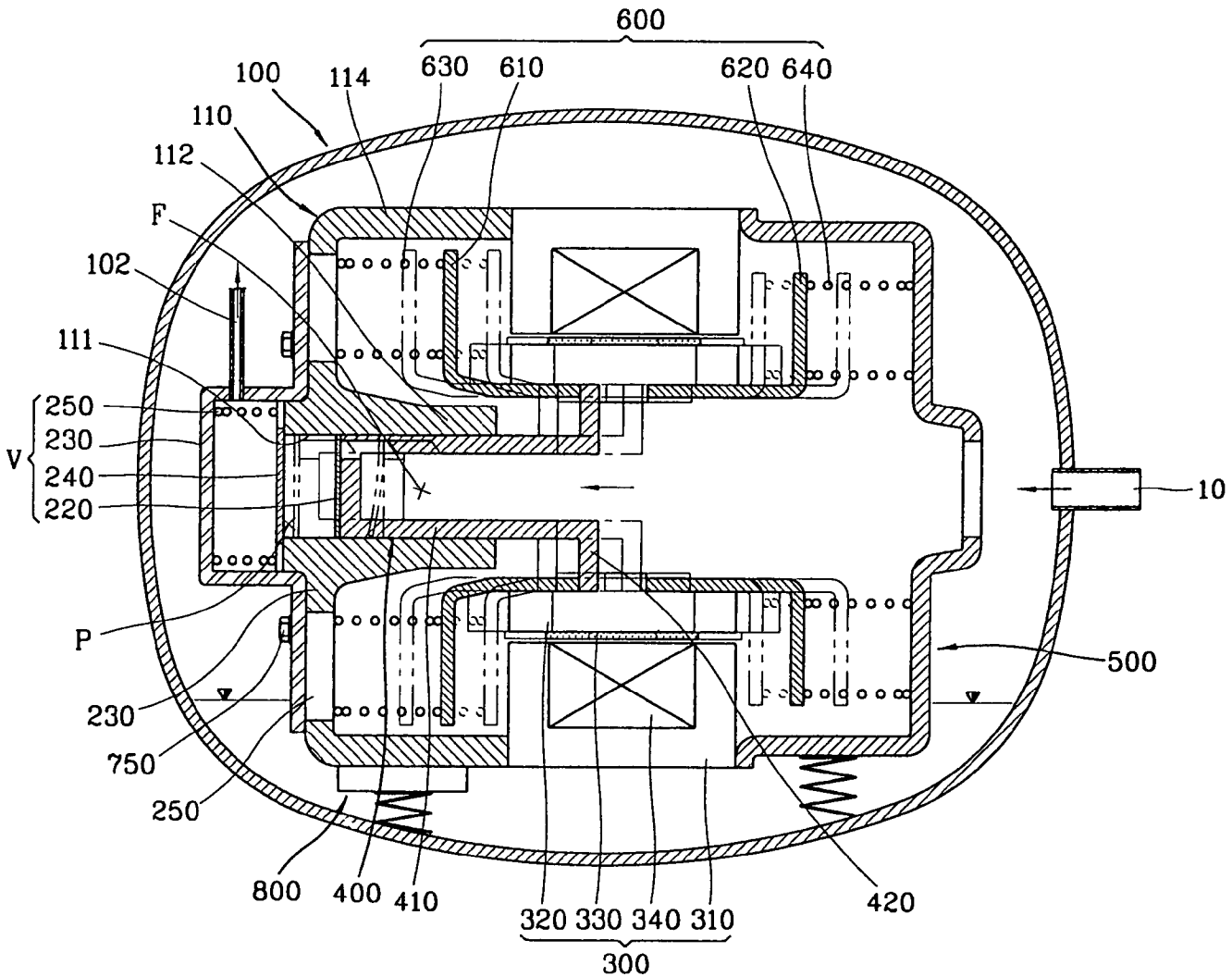
FIG. 17 is a sectional view illustrating an operation state of a reciprocating compressor having a reliability-improving structure in accordance with the present invention.

As depicted in FIG. 17, the linear reciprocating driving force of the inner stator 320 and the magnets 330, 360 is transmitted to the piston 400, the piston 400 performs the linear reciprocating motion in the cylinder unit through hole 210 of the front frame 200 with the inner stator 320 and the magnets 330, 360. According to the linear reciprocating motion of the piston 400, coolant sucked into the suction pipe 10 with the operation of the valve unit 700 flows through the gas flow path F of the piston 400, is sucked into the compression space P, is compressed, and the compressed high temperature-high pressure is discharged through the discharge cover 720 and the discharge pipe 20. The operation is performed repeatedly.

In the meantime, in the linear reciprocating motion of the piston 400 with the inner stator 320 and the magnets 330, 360 of the reciprocating motor 300, the resonance spring unit 600 stores-emits the linear reciprocating driving force of the reciprocating motor 300 as elastic energy and induces a resonance motion.

In more detail, when the piston 400 is moved to a bottom dead center, the first spring 630 is tensed, simultaneously the second spring 640 is compressed. When the piston 400 is moved to a top dead center, the first spring 630 is compressed, simultaneously the second spring 640 is tensed and elastically supports the piston 400, the inner stator 320 and the magnets 330, 360.

In the present invention, because the piston 400 receives the linear reciprocating driving force of the reciprocating motor 300 and compresses gas while performing the linear reciprocating motion in the through hole 210 of the front frame 200, the operation is performed in a stable state.

In more detail, unlike the conventional art, not adapting a mechanism for compressing gas with volume variation using a rotation motion or a mechanism for compressing gas by converting a rotation motion into a linear reciprocating motion, but adapting a mechanism for transmitting the linear reciprocating driving force to the piston 400 and compressing gas while performing the linear reciprocating motion in the through hole 210 of the front frame 200, the gas compressing operation is stable, vibration can be minimized, and there is no need to add an additional part in order to stabilize the operation.

In addition, when it is possible to control a linear operational distance of the reciprocating motor 300, a stroke, namely, an operational distance of the piston 400 can be adjusted, and accordingly it is possible to adjust a quantity of compression gas accurately.

In the present invention, because the inner stator 320, the magnets 330, 360 are combined with the piston 400 and are moved together, it is possible to minimize an air gap G between the outer stator 310 and the inner stator 320 of the reciprocating motor 300 and facilitate air gap management.

In the present invention, a structure and the number of construction parts of a motor part for generating a linear reciprocating driving force and a compression part for compressing gas can be simplified.

Figure 8:
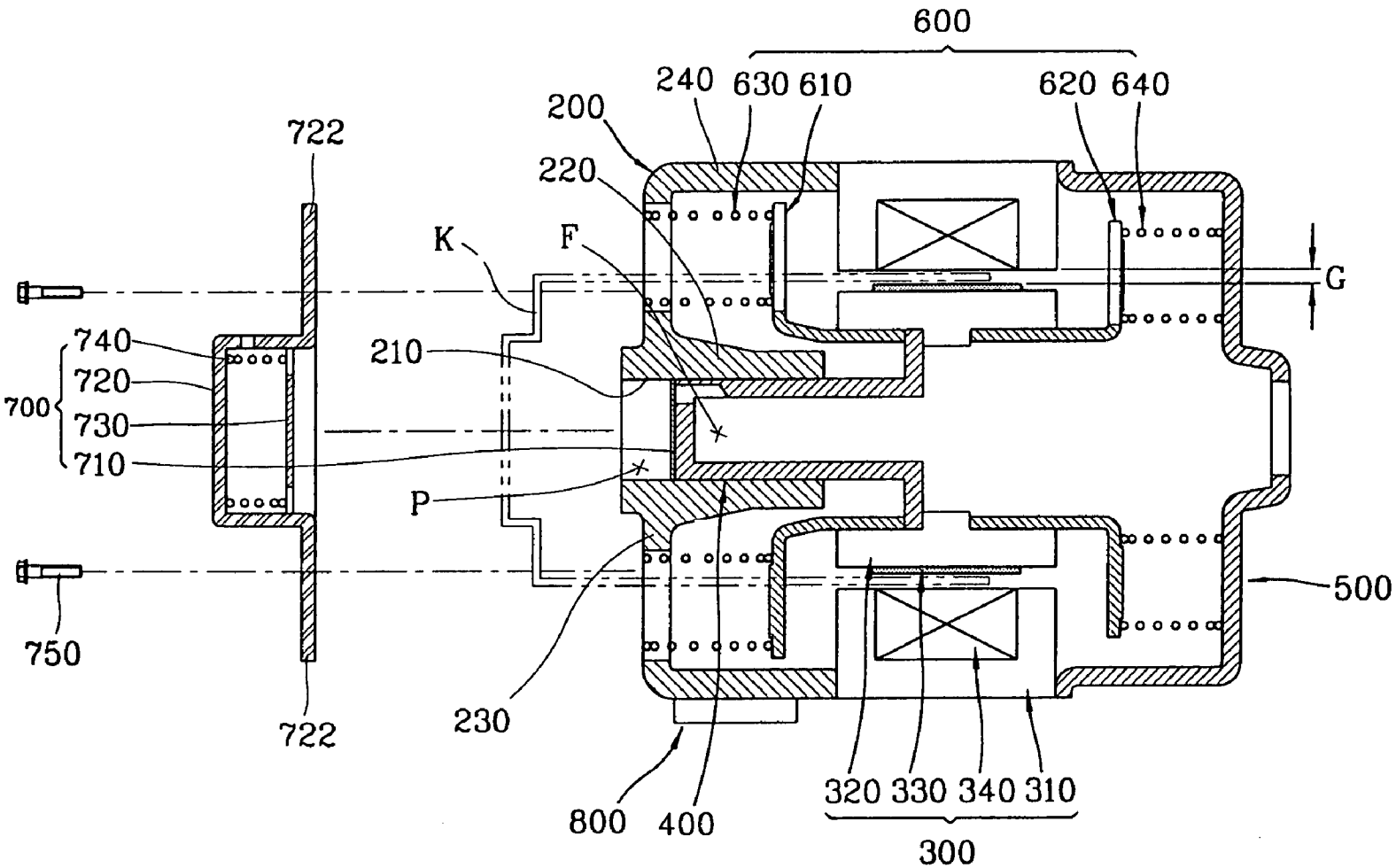
FIG. 8 is an exploded-sectional view illustrating another embodiment of the reliability-improving structure of the reciprocating compressor in accordance with the present invention.

And, as depicted in FIG. 8, by inserting a gap gauge K through the measuring hole 250 of the front frame 200, an air gap G between the outer stator 310 and the inner stator 320 of the reciprocating motor 300 can be measured. Afterward, the first spring 630 is inserted through the measuring hole 250.

Herein, the other side of the first spring 630 is supported by the first spring supporter 610.

And, the discharge cover 720 of the valve unit 700 is combined with the front frame 200 so as to cover the through hole 210 and the measuring hole 250 of the front frame 200, and the discharge cover 720 is fixedly combined with the front frame 200 by the plural bolts 750.

Herein, the other side of the first spring 630 is supported by the extended portion 722 of the discharge cover 720.

In the present invention, the magnet 360 combined with the inner stator 350 is fixedly inserted into the installation groove 352 formed on the outer circumference of the cylindrical body 351 of the inner stator 350, the combining is firm, particularly it is possible to maintain the firm combining state of the magnet 360 even in the axial direction or circumferential direction vibration.

In addition, because the magnet 360 is inserted-fixed to the installation groove 352 of the inner stator 350, an air gap between the inner stator 350 and the outer stator 310 is reduced, and accordingly output of the motor can be improved.

And, when the magnet 360 is fixedly combined with the inner stator 350 by the magnet fixing member 370, because the magnet 360 is supported-fixed to the inner stator 350 by the magnet fixing member 370, it is possible to firm the combining of the magnet, particularly it is possible to maintain the firm combining state of the magnet 360 even in the axial direction or circumferential direction vibration.

INDUSTRIAL APPLICABILITY

As described above, in a reliability-improving structure of a reciprocating compressor in accordance with the present invention, because an operation state is stable, vibration and noise can be minimized, and accordingly reliability of the reciprocating compressor can be improved. Because it is possible to simplify construction parts, fabrication and assembly processes can be performed easily, and accordingly assembly productivity can be improved. In addition, by reducing an air gap of a reciprocating motor for generating a linear reciprocating driving force, output of the reciprocating motor can be improved. And, it is possible to adjust accurately a quantity of compression gas discharge by a piston stroke control, unnecessary loss can be reduced, and accordingly power consumption can be lowered.

In addition, in the present invention, in the assembly process, by measuring an air gap of the reciprocating motor in order to maintain the air gap uniformly, it is possible to reduce fabrication error and assembly error by preventing irregular air gap occurrence in the assembly, damage due to wrong operation can be prevented, a stable operation can be performed, and accordingly reliability of the reciprocating compressor can be improved.

In addition, in the present invention, by combining firmly an inner stator and magnets of the reciprocating motor, when the piston receives the linear reciprocating driving force of the reciprocating motor and compresses gas while performing the linear reciprocating motion together with the inner stator and the magnet of the reciprocating motor, it is possible to prevent separation of the magnets from the inner stator even in vibration occurrence or long term operation, and accordingly reliability of the reciprocating compressor can be improved.

The invention claimed is:

1. A reliability-improving structure of a reciprocating compressor, comprising:

a container having a suction pipe in which gas is sucked;

an outer stator disposed in the container, and an inner stator inserted into the outer stator so as to be movable;

a reciprocating motor having a magnet fixedly combined with the inner stator so as to be movable with the inner stator;

a front frame having a cylinder unit at which a through hole is formed and combined so as to support the outer stator of the reciprocating motor;

a piston inserted into the through hole of the cylinder unit of the front frame, combined with the inner stator of the reciprocating motor, receiving a linear reciprocating driving force of the reciprocating motor and performing a linear reciprocating motion with the inner stator and the magnet;

a rear frame unit for covering the piston and fixedly supporting the reciprocating motor;

a resonance spring unit having a first spring supporter fixedly combined with a side of the inner stator or the piston so as to place at the front frame side, a second spring supporter fixedly combined with the other side of the inner stator or the piston so as to place at the rear frame unit side, a first spring arranged between the first spring supporter and the front frame, and a second spring arranged between the second spring supporter and the rear frame unit; and a valve unit for sucking and discharging gas according to the linear reciprocating motion of the piston.

2. The structure of claim 1, wherein a length of the inner stator of the reciprocating motor is longer than that of the outer stator and is arranged in a movement direction of the reciprocating motor.

3. The structure of claim 1, wherein the piston includes;

a piston body portion having a certain length and arranged in the compression space P;

a flange portion curved-extended from the end of the piston body portion so as to have a certain area; and a fixed guide portion extended-formed at a surface of the flange portion so as to have a certain outer diameter and a length in a length direction; wherein the inner stator includes:

a cylindrical body;

a first combining portion formed inside the cylindrical body so as to have an inner diameter corresponded to an outer diameter of the flange portion of the piston; and a second combining portion abutting on the first combining portion and pierced-formed through the cylindrical body so as to have an inner diameter corresponded to an outer diameter of the fixed guide portion of the piston; herein the first combining portion of the inner stator is fixedly inserted into the flange portion of the piston, and the second combining portion of the inner stator is combined with the fixed guide portion of the piston.

4. The structure of claim 1, wherein a certain-shaped plural measuring holes are pierced through the front frame after assembling construction parts of the reciprocating compressor in order to insert a gap gauge for measuring an air gap of the reciprocating motor into an air gap of the reciprocating motor through the front frame, and an opening/closing means for opening/closing the measuring holes is arranged on the front frame.

5. The structure of claim 4, wherein the opening/closing means is included in the valve unit, and the opening/closing means consists of an extended portion arranged on a discharge cover for covering a compression space in order to cover the measuring holes; and plural fastening bolts for combining the discharge cover with the front frame.

6. The structure of claim 4, wherein a side of the first spring is arranged on the measuring hole of a plate portion of the front frame and is supported by an extended portion of the discharge cover.

7. The structure of claim 1, wherein the inner stator is inserted into the outer stator of the reciprocating motor for generating the linear reciprocating driving force so as to perform the linear motion, the magnet is contacted to the outer circumference of the inner stator so as to place between the inner stator and the outer stator, and a certain-shaped magnet fixing member is fixedly combined with the inner stator and fixedly supports the magnet.

8. The structure of claim 7, wherein the magnet fixing member is respectively arranged on the both sides of the magnet in the long axis direction and includes:

a horizontal contact portion having a certain thickness and length, contacted and joined to the outer circumference of the inner stator; and a vertical portion curved-extended from the horizontal contact portion so as to have a height shorter than a thickness of the magnet and supporting the side surface of the magnet.

* * * * *